US010597217B2

(12) United States Patent
Krus

(10) Patent No.: US 10,597,217 B2
(45) Date of Patent: Mar. 24, 2020

(54) VACUUM-DRAWING LID

(71) Applicant: Taylor Precision Products, Inc., Seattle, WA (US)

(72) Inventor: Matthew Krus, Seattle, WA (US)

(73) Assignee: LIFETIME BRANDS, INC., Garden City, NY (US)

( * ) Notice: Subject to any disclaimer, the term of this patent is extended or adjusted under 35 U.S.C. 154(b) by 113 days.

(21) Appl. No.: 15/891,006

(22) Filed: Feb. 7, 2018

(65) Prior Publication Data

US 2018/0222660 A1 Aug. 9, 2018

Related U.S. Application Data

(60) Provisional application No. 62/456,303, filed on Feb. 8, 2017.

(51) Int. Cl.

| | |
|---|---|
| ***B65D 81/20*** | (2006.01) |
| ***B65D 43/02*** | (2006.01) |
| ***B65D 51/16*** | (2006.01) |

(52) U.S. Cl.

CPC ..... *B65D 81/2038* (2013.01); *B65D 43/0202* (2013.01); *B65D 51/1683* (2013.01); *B65D 2543/00092* (2013.01); *B65D 2543/00231* (2013.01); *B65D 2543/00833* (2013.01)

(58) Field of Classification Search

CPC ..... B65D 81/2038; B65D 51/1683; B65D 43/0202; B65D 2543/00092; B65D 2543/00833; B65D 2543/00231

USPC ..... 215/313, 314

See application file for complete search history.

(56) References Cited

U.S. PATENT DOCUMENTS

| | | | | |
|---|---|---|---|---|
| 1,788,795 | A * | 1/1931 | Hoban | B65D 47/2062 222/544 |
| 2,533,915 | A * | 12/1950 | Brooks | B65D 47/265 222/513 |
| 4,823,968 | A * | 4/1989 | Handzlik | B65B 31/047 215/228 |
| 5,944,212 | A * | 8/1999 | Chang | B65D 81/2038 215/228 |
| 2005/0247660 | A1* | 11/2005 | Michalopoulos | B65D 81/2038 215/228 |
| 2010/0155429 | A1* | 6/2010 | Haimi | B65B 31/00 222/383.2 |

OTHER PUBLICATIONS

Vacucraft, "Singles," https://vacucraft.net/3-singles, Archived by the Internet Archive on Nov. 5, 2016; Accessed via the Wayback Machine on Feb. 7, 2018, 25 pages.

Vacuvin, "Store," https://vacuvin.com:80/911/Store, Archived by the Internet Archive on Jan. 11, 2017; Accessed via the Wayback Machine on Feb. 7, 2018, 3 pages.

* cited by examiner

*Primary Examiner* — James N Smalley

(74) *Attorney, Agent, or Firm* — Tutunjian & Bitetto, P.C.

(57) ABSTRACT

A vacuum-drawing lid can include a base frame with a first one-way valve, a piston with a second one-way valve, and a cylindrical cam with a sinusoidal groove formed on an inner surface thereof to drive reciprocation of the piston as the cylindrical cam turns. Turning the cylindrical cam in a first direction can drive the piston to translate in a first direction and actuate the first valve. Turning the cylindrical cam in a second direction can drive the piston to translate in a second direction and actuate the second valve.

15 Claims, 18 Drawing Sheets

VACUUM-DRAWING LID

BACKGROUND

Technical Field

The present disclosure relates generally to lids, and more specifically to lids that can be used to draw a vacuum on a container they cover.

Description of the Related Art

A wide variety of containers, such as air-tight containers, and lids for such containers, are commercially available. In various applications, it can be advantageous to draw a vacuum on a closed air-tight container. For example, drawing a vacuum on a closed container can slow oxidation of wine within the closed container, or can speed up a pickling process within the closed container. Thus, pumps designed to draw a vacuum in a container and allow the container to be plugged or capped with a vacuum therein have been developed and are commercially available.

BRIEF SUMMARY

A lid for sealing a container may comprise: a base frame including a first valve; a piston including a second valve; and a chamber bounded at least in part by the base frame and the piston, the piston movable in a first direction with respect to the base frame to change a volume of the chamber to actuate the first valve, the piston movable in a second direction opposite to the first direction to change the volume of the chamber to actuate the second valve.

The piston may be movable in the first direction with respect to the base frame to actuate the first valve and not actuate the second valve, and the piston may be movable in the second direction to actuate the second valve and not actuate the first valve. The first valve may be a one-way flapper valve that can be actuated to allow gas to flow into the lid and into the chamber. The second valve may be a one-way flapper valve that can be actuated to allow gas to flow out of the chamber and out of the lid. The base frame may include a plurality of vertically-extending ridges and the piston may include a plurality of vertically-extending grooves engaged with the ridges. The engagement of the grooves with the ridges may prevent the piston from rotating with respect to the base frame but allow the piston to translate with respect to the base frame.

The piston may include a main body and a knob protruding radially outward from the main body. The lid may further comprise a cylindrical cam including a hollow body with an inner surface and a groove formed in the inner surface. The knob may be positioned in the groove so that rotation of the cylindrical cam causes the piston to move with respect to the base frame to change the volume of the chamber. The groove may be a sinusoidal groove. The lid may further comprise: a top cap including a plurality of vertically-extending ridges; wherein the hollow body of the cylindrical cam has an outer surface and includes a plurality of vertically-extending grooves in the outer surface, the vertically extending grooves engaged with the vertically-extending ridges. The engagement of the grooves with the ridges may prevent the top cap from rotating with respect to the cylindrical cam.

The lid may further comprise: a top cap including a plurality of protrusions; wherein the base frame has an outer surface and includes a circumferential groove formed in the outer surface, the circumferential groove engaged with the protrusions. The engagement of the groove with the protrusions may prevent the top cap from translating with respect to the base frame. The lid may further comprise: a bottom gasket that extends around and is sealed against an outer surface of the base frame. The bottom gasket may be configured to engage with and create a seal against an upper rim of the container. The lid may further comprise: an inner gasket assembly engaged with and sealed against the base frame and engaged with and sealed against the piston.

A method of using a lid to seal a container may be summarized as comprising: moving a piston within the lid in a first direction with respect to a base frame of the lid, the piston including a first valve and the base frame including a second valve, to change a volume of a chamber bounded at least in part by the piston and the base frame, and to actuate the first valve; and moving the piston in a second direction with respect to a base frame opposite to the first direction to change the volume of the chamber and to actuate the second valve. Using the lid to seal the container may accelerate a pickling process within the container, may preserve the freshness of wine held in the container, or may remove air entrained within a liquid held in the container.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
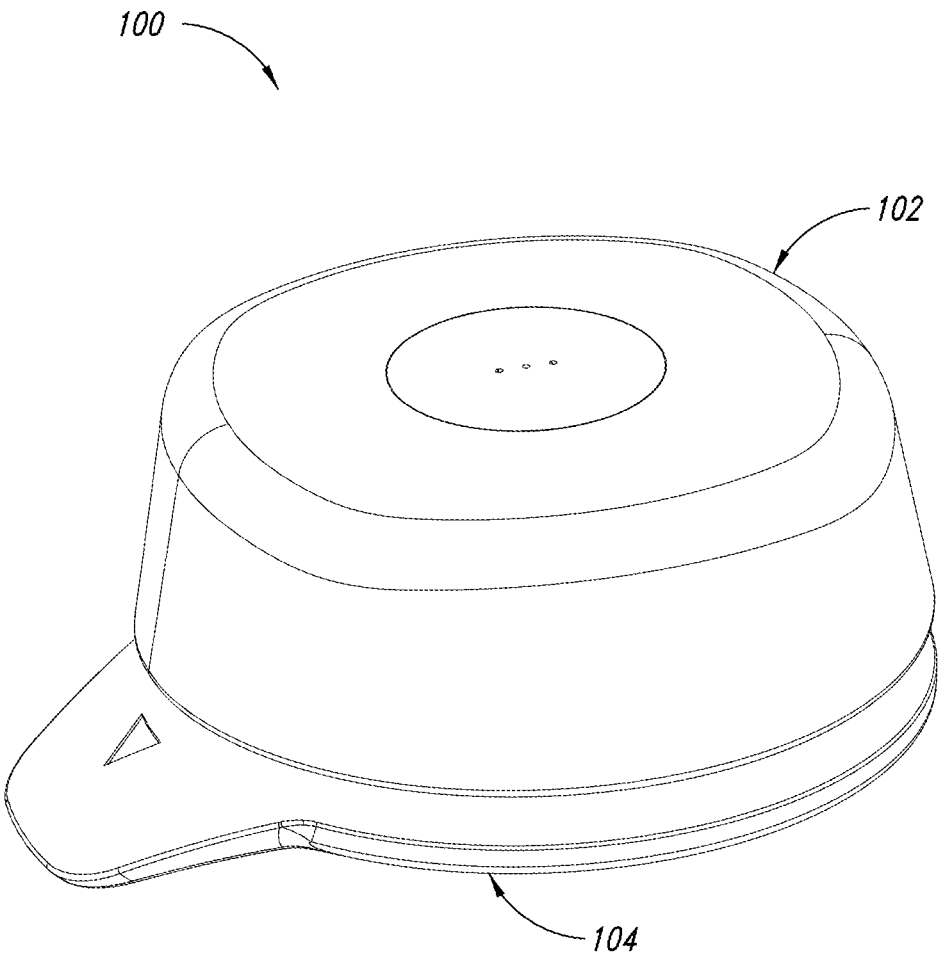
FIG. 1 illustrates a top view of a vacuum-drawing lid.

FIG. 1 illustrates a top, perspective view of a vacuum-drawing lid 100, according to one embodiment. The lid 100 includes a top cap 102 and a bottom gasket 104. Unless the context clearly dictates otherwise, as used herein, "top," "bottom," "up," "down," above," "below," and other terms of relative elevation are used in their conventional sense, that is, such that when the lid 100 is in use, a top end of the lid 100 is above a bottom end of the lid 100 with respect to the force of gravity.

To use the vacuum-drawing lid 100, a user can place the bottom gasket 104 on an upper rim of a vessel or container such as a bottle, jar, flask, bowl, can, thermos, pot, etc, with a glass mason jar being one specific example. The user can then push the lid 100 onto the container to create a seal between the container and the bottom gasket 104, which can therefore be referred to as a "container gasket" 104. The user can then rotate the top cap 102 with respect to the container gasket 104, to draw air out of the container and thereby draw a vacuum within the container. The top cap 102 can therefore be referred to as a "handle" 102 of the lid 100.

Various components of the lid 100, including the top cap 102, have generally circular profiles when viewed from the top or from the bottom, and therefore have a central longitudinal axis that extends upwards and downwards through the geometric center of the circular profile of the respective component. Unless the context clearly dictates otherwise, the central longitudinal axes of the various components of the lid 100 described herein are co-axial with one another. Unless the context clearly dictates otherwise, as used herein, "rotate," "turn," "revolve," "spin," and other terms describing rotation are used to mean that a component of the lid 100 is rotating with respect to its own central longitudinal axis. Unless the context clearly dictates otherwise, as used herein, "translate" and other terms describing linear movement or geometric displacement are used to mean that a component of the lid 100 is translating along its own central longitudinal axis.

Figure 2:
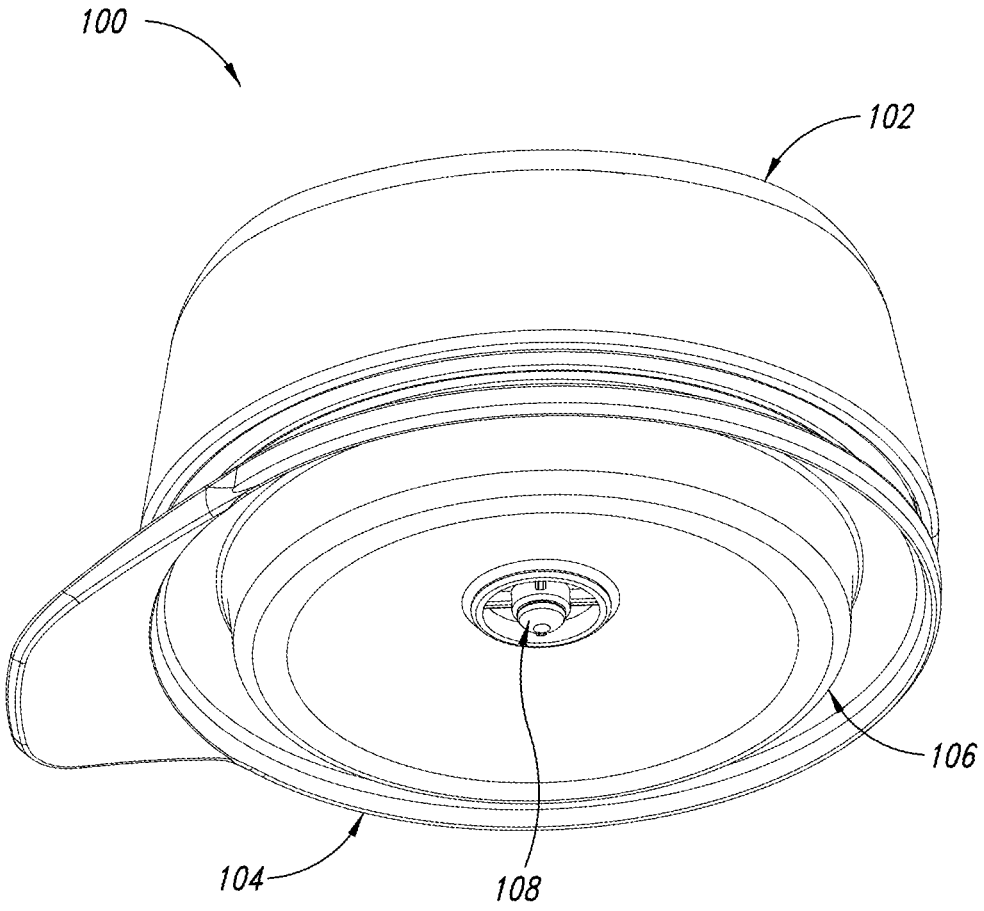
FIG. 2 illustrates a bottom view of the lid of FIG. 1.

FIG. 2 illustrates a bottom perspective view of the vacuum-drawing lid 100. As shown in FIG. 2, the top cap 102 and the container gasket 104 are coupled to a base frame 106 of the lid 100. When the vacuum-drawing lid 100 is in use, the base frame 106 is stationary, that is, it does not rotate or translate with respect to the container to which it is sealed. The base frame 106 can therefore be viewed as a foundation or a housing to which other components of the lid 100 are coupled. The other components of the lid 100 can be fixed or stationary with respect to the base frame 106 and therefore with respect to the container when the lid 100 is in use, or can be movable, such as rotatable and/or translatable, with respect to the base frame 106 and therefore with respect to the container when the lid 100 is in use.

As one example, when the lid 100 is in use, the top cap 102 is rotatable with respect to the base frame 106, but is not translatable with respect to the base frame 106. As another example, when the lid 100 is in use, an inner surface of the container gasket 104 is sealed to an outer surface of the base frame 106 and is neither rotatable nor translatable with respect to the base frame 106, although a user can pull on the container gasket 104 to separate it from the base frame 106 and thereby break the seal between the container gasket 104 and the base frame 106, as described more fully below. The base frame 106 includes a flapper portion 108 of a first, bottom flapper valve, which is a one-way valve, and which allows the lid 100 to draw air out of the container to which it is sealed, and into an interior of the lid 100, as described further below.

Figure 3:
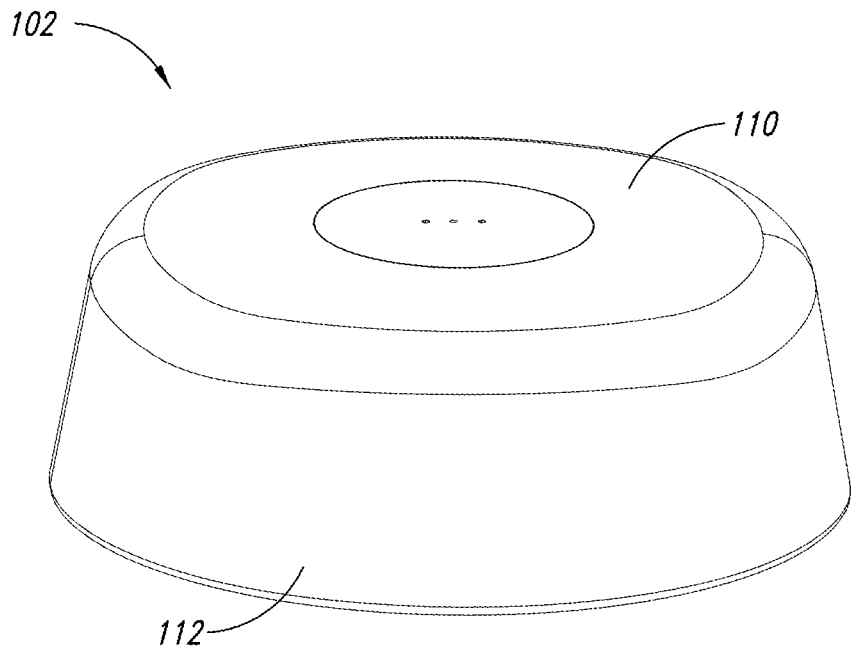
FIG. 3 illustrates a top view of a top cap of the lid of FIG. 1.
Figure 4:
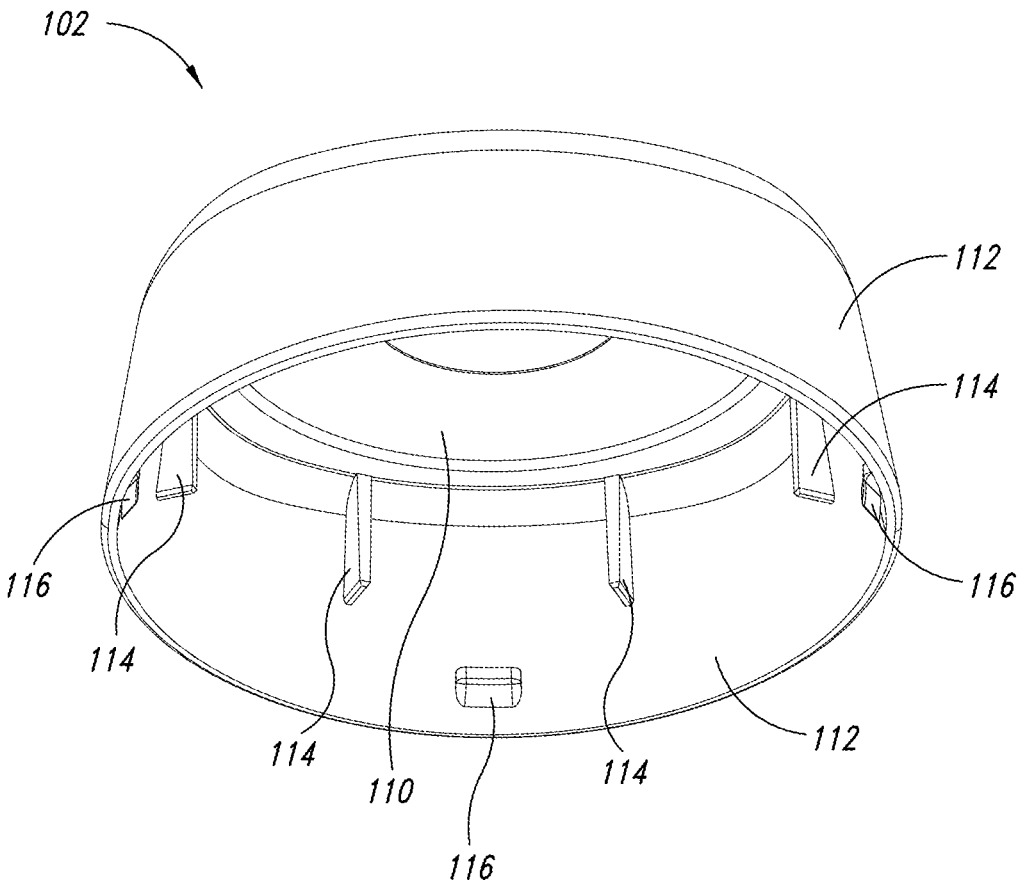
FIG. 4 illustrates a bottom view of the top cap of FIG. 3.

FIG. 3 illustrates a top perspective view, and FIG. 4 illustrates a bottom perspective view, of the top cap 102. As shown in FIGS. 3 and 4, the top cap 102 comprises an upside-down bowl, including a top circular or disk portion 110 and an outer, generally cylindrical rim 112 that extends downward from the top circular portion 110, which has a diameter that increases as it extends downward away from the top circular portion 110. As shown in FIG. 4, the top cap 102 includes eight ridges 114 that extend radially inwardly from the outer rim 112 and vertically downward from the top circular portion 110 to about the vertical midpoint of the outer rim 112. The eight ridges 114 (four are visible in FIG. 4) are equally spaced apart from one another around the inner circumference of the outer rim 112, and engage with complementary grooves in other components of the lid 100, as described further below.

As also shown in FIG. 4, the top cap 102 includes four protrusions or clips 116 coupled to the inner surface of the outer rim 112 near a bottom end of the outer rim 112, which extend radially inward from the outer rim 112. The four clips 116 (three are visible in FIG. 4) are equally spaced apart from one another around the inner circumference of the outer rim 112, and can be engaged with a complementary groove formed in the base frame 106, to rotatably couple and hold the top cap 102 to the base frame 106.

Figure 5:
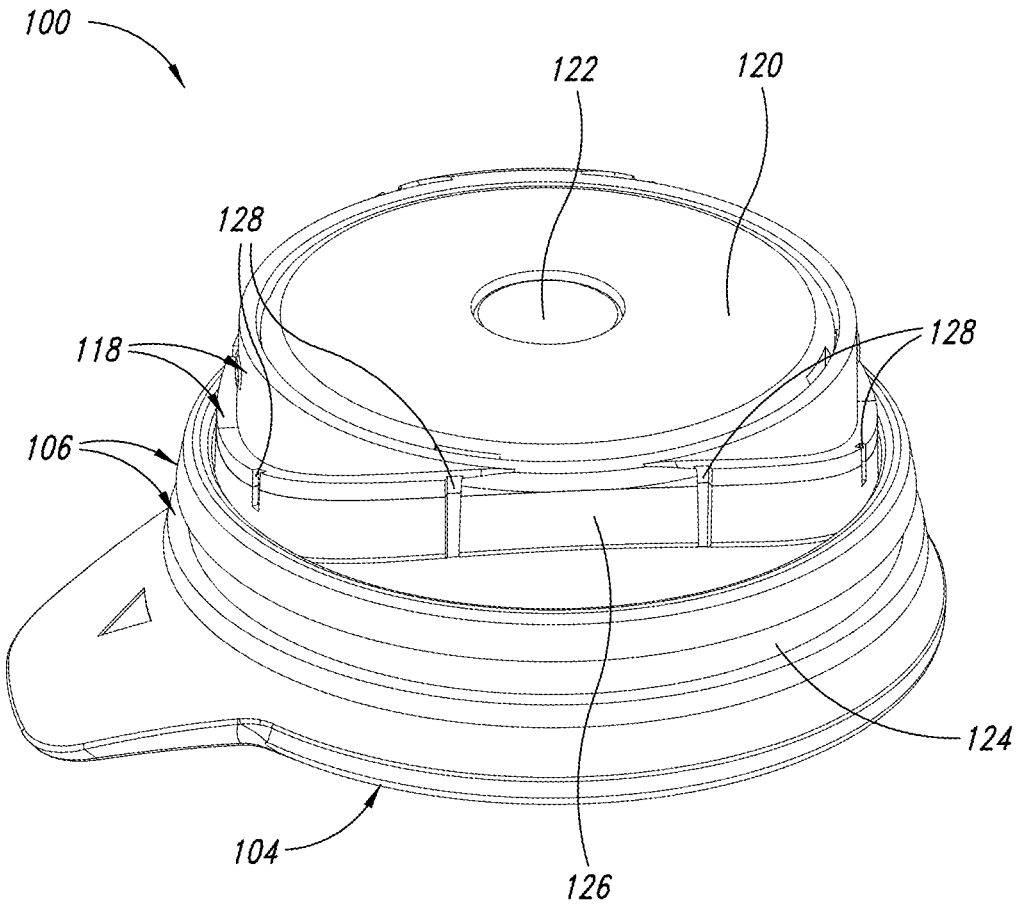
FIG. 5 illustrates the lid of FIG. 1 without the top cap of FIG. 3.

FIG. 5 illustrates the vacuum-drawing lid 100 of FIG. 1, with the top cap 102 removed to reveal additional components of the lid 100. For example, FIG. 5 shows that the base frame 106 includes a peripheral and circumferential groove 124 formed in its outer surface, which is complementary to the clips 116 so that the clips 116 can be seated within the groove 124 to couple and hold the top cap 102 to the base frame 106. As another example, the vacuum-drawing lid 100 can also include a cylindrical cam 118.

The cylindrical cam 118 includes a generally cylindrical main body with a generally cylindrical inner surface having a sinusoidal groove cut therein, as described further below. The generally cylindrical main body of the cylindrical cam 118 also has a generally cylindrical outer surface with a sinusoidal protrusion or ridge 126 extending radially outward therefrom, which corresponds to a negative feature of the sinusoidal groove formed in the inner surface of the cylindrical main body of the cylindrical cam 118, and which allows the sinusoidal groove formed in the inner surface of the cylindrical cam 118 to be as deep as or deeper than a thickness of most of the main body of the cylindrical cam 118.

The sinusoidal ridge 126 formed in the outer surface of the main body of the cylindrical cam 118 includes eight vertically extending grooves 128 that are complementary to the ridges 114 formed in the interior of the top cap 102, and that are equally spaced about the exterior of the cylindrical cam 118. Thus, when the top cap 102 is coupled to the rest of the lid 100 and its clips 116 are seated within the groove 124, the ridges 114 are seated within and engaged with the grooves 128, so that the cylindrical cam 118 is rotationally locked to the top cap 102, and therefore rotatable with respect to the base frame 106. Furthermore, a top end of the cylindrical cam 118 can be engaged with a bottom surface of the top circular portion 110 of the top cap 102, and a bottom end of the cylindrical cam 118 can be engaged with a shelf formed by the base frame 106, as described further below, so that the cylindrical cam 118 is translationally locked with respect to the top cap 102, and therefore also translationally locked to the base frame 106.

FIG. 5 also illustrates that the lid 100 includes a cam follower 120, which can be actuated by rotation of the cylindrical cam 118 to translate up and down to drive a pumping action of the lid 100, and can therefore also be referred to as a "piston" 120 or a "pump" 120. FIG. 5 shows that the piston 120 includes a flapper portion 122 of a second, top flapper valve, which is a one-way valve, and which allows the lid 100 to draw air out of the interior of the lid 100 and into the atmosphere, as described further below.

Figure 6:
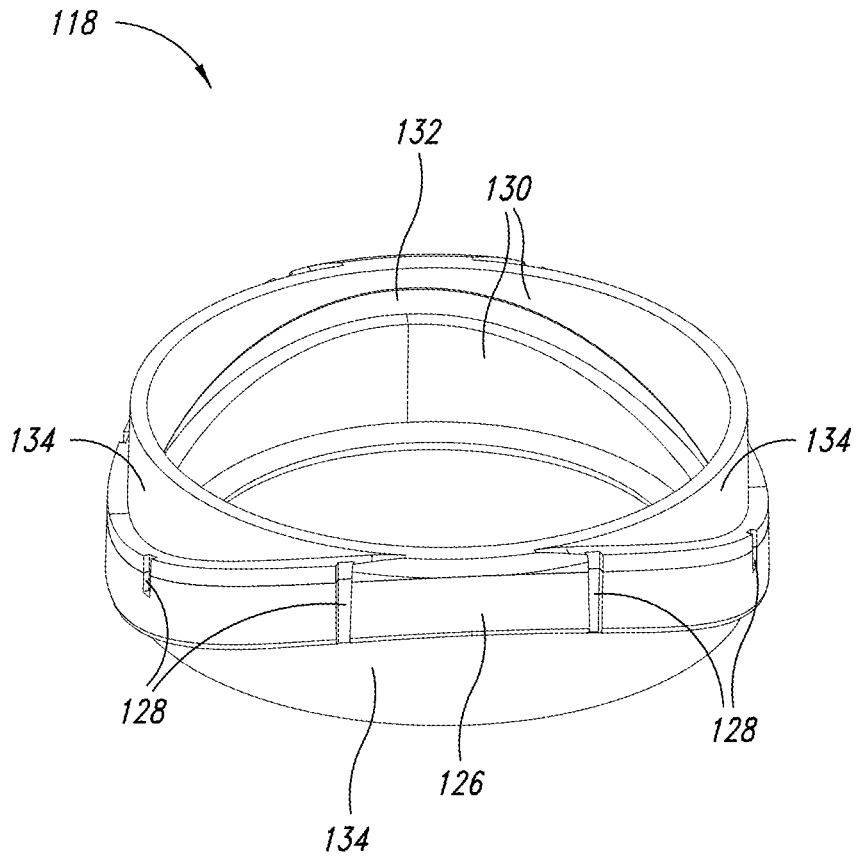
FIG. 6 illustrates a top view of a cam of the lid of FIG. 1.
Figure 7:
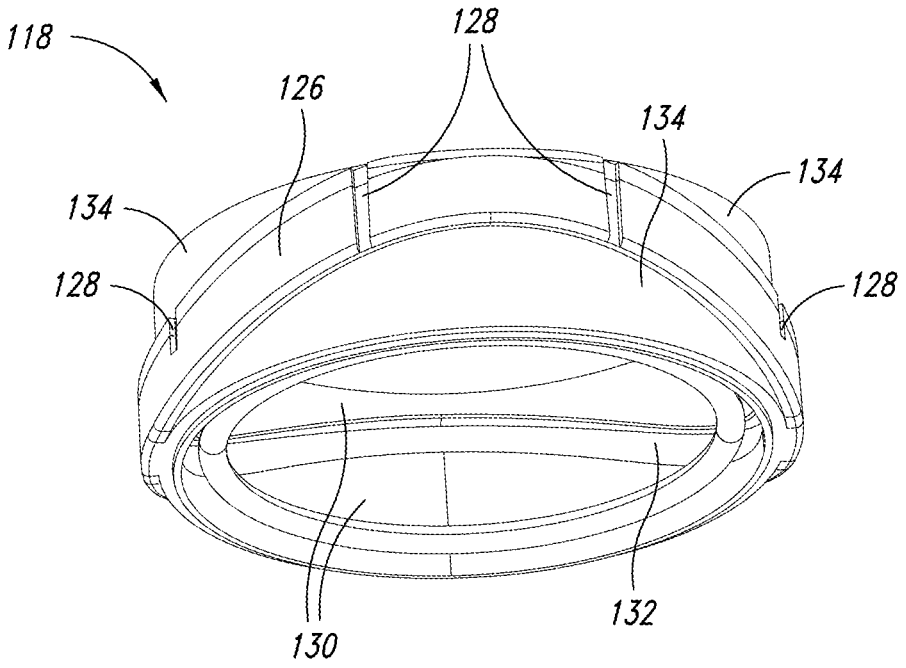
FIG. 7 illustrates a bottom view of the cam of FIG. 6.

FIG. 6 illustrates a top perspective view, and FIG. 7 illustrates a bottom perspective view, of the cylindrical cam 118. FIGS. 6 and 7 illustrate that the cylindrical cam 118 includes the cylindrical inner surface 130 with the sinusoidal groove 132 formed therein, and the cylindrical outer surface 134 with the sinusoidal ridge 126 formed therein. The sinusoidal groove 132 and the sinusoidal ridge 126 each have two peaks and two valleys, such that a full rotation of the top cap 102, which causes a full rotation of the cylindrical cam 118, also causes the piston 120 to be driven completely upwards and completely downwards, which can be referred to as being "pumped," twice. In some embodiments, the sinusoidal groove 132 and the sinusoidal ridge 126 can each have three peaks and three valleys, such that a full rotation of the top cap 102 causes the piston 120 to be pumped three times. In general, any suitable number of peaks and valleys can be used, so that a full rotation of the top cap 102 causes the piston 120 to be pumped a corresponding number of times.

Figure 8:
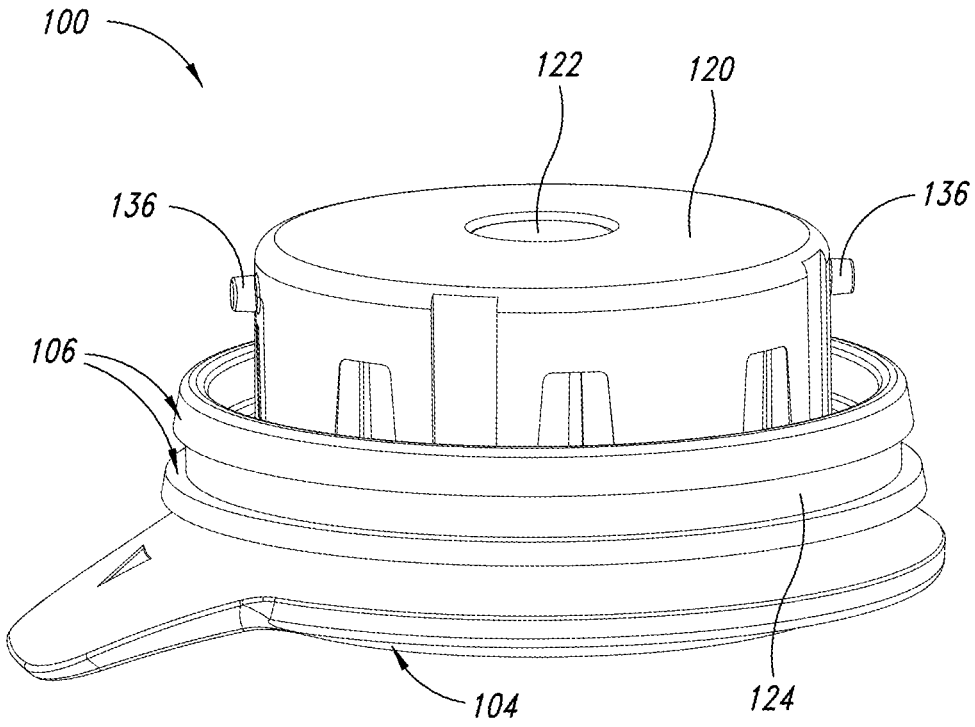
FIG. 8 illustrates the lid as shown in FIG. 5 without the cam of FIG. 6.

FIG. 8 illustrates the vacuum-drawing lid 100 of FIG. 1, with the top cap 102 and the cylindrical cam 118 removed to reveal additional features of the lid 100. For example, FIG. 8 shows that the piston 120 includes a first protrusion or knob 136 extending radially outward from a side surface of the piston 120 from a location near an upper portion of the piston 120, and a second protrusion or knob 136 extending radially outward from a side surface of the piston 120 from a location near an upper portion of the piston 120. The two knobs 136 extend radially outward from the piston 120 at respective locations separated from one another by 180 degrees around the outer circumference of the piston 120, such that the knobs 136 have respective central longitudinal axes that are coaxial with one another and extend radially outward from the piston 120 in opposite directions that are perpendicular to the central longitudinal axes of the piston 120 and various other components of the lid 100. In cases where the sinusoidal groove 132 and the sinusoidal ridge 126 have three peaks and three valleys, the piston 120 can include three equidistantly spaced protrusions or knobs 136 instead of two, which can be positioned at respective locations separated from one another by 120 degrees around the outer circumference of the piston 120. In cases where the groove 132 includes three peaks and three valleys, the three knobs 136 can form a relatively stable three-point support for the piston 120 on the cam 118. In general, the piston 120 can include any suitable number of equidistantly spaced protrusions or knobs 136, which can correspond to the number of peaks and valleys formed in the sinusoidal groove 132 and the sinusoidal ridge 126.

Figure 9:
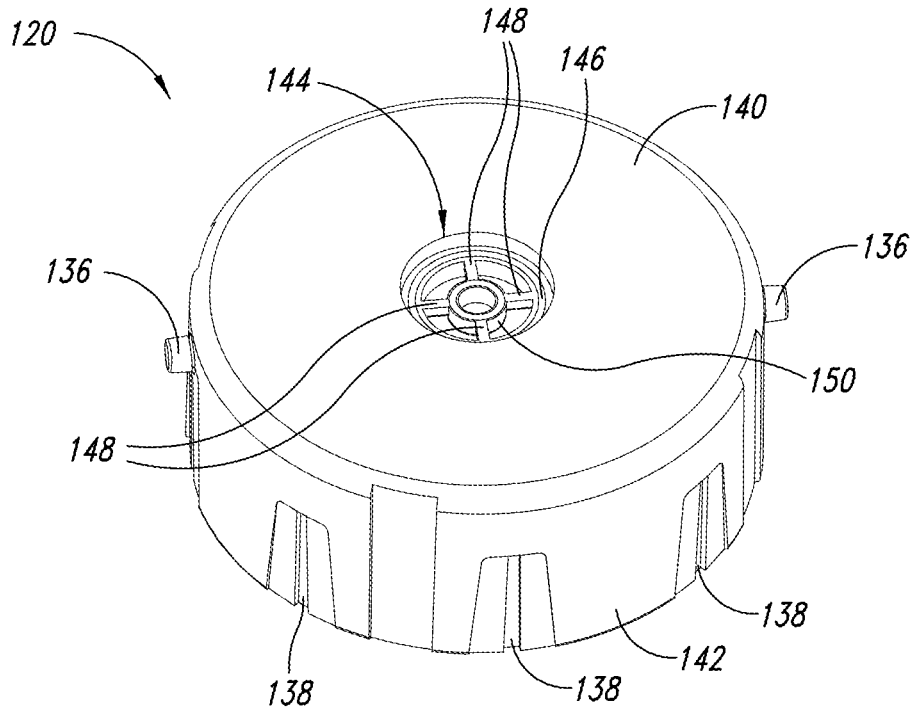
FIG. 9 illustrates a top view of a piston of the lid of FIG. 1.
Figure 10:
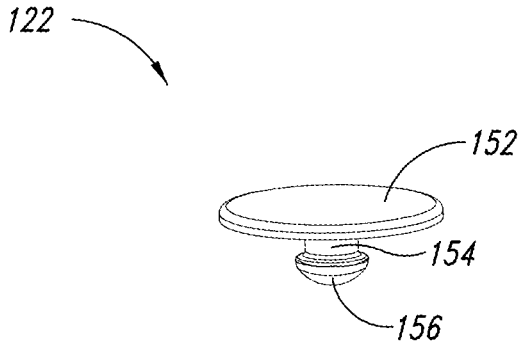
FIG. 10 illustrates a top view of a flapper portion of a flapper valve formed with the piston of FIG. 9.
Figure 11:
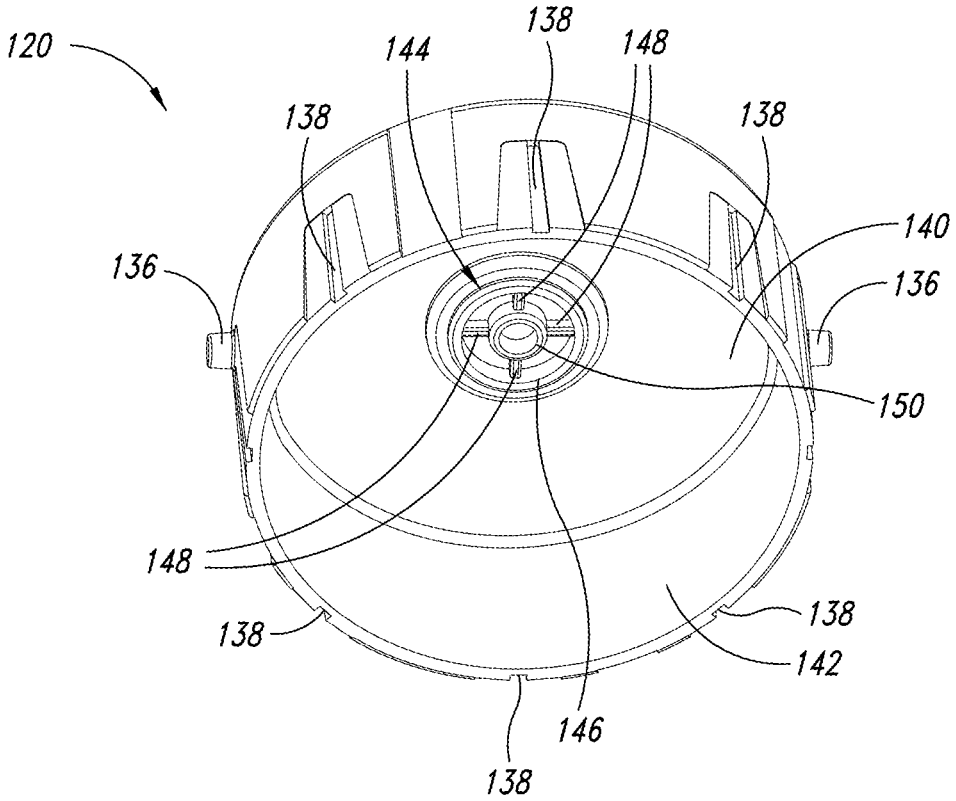
FIG. 11 illustrates a bottom view of the piston of FIG. 9.
Figure 12:
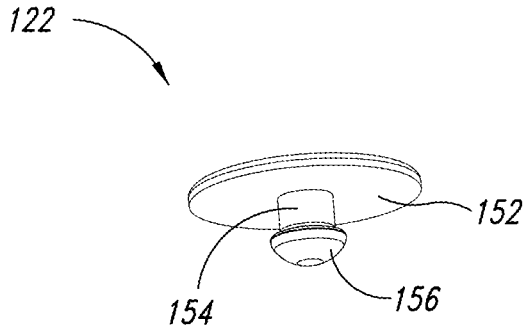
FIG. 12 illustrates a bottom view of the flapper portion of FIG. 10.

FIG. 9 illustrates a top perspective view of the piston 120 separated from the rest of the lid 100, including the flapper portion 122, and FIG. 10 illustrates a top perspective view of the flapper portion 122. FIG. 11 illustrates a bottom perspective view of the piston 120 separated from the rest of the lid 100, including the flapper portion 122, and FIG. 12 illustrates a bottom perspective view of the flapper portion 122. As shown in FIGS. 9 and 11, the piston 120 comprises an upside-down bowl, including a top circular or disk portion 140 and an outer, generally cylindrical rim 142 that extends downward from the top circular portion 140. As illustrated in FIGS. 9 and 11, the piston 120 includes eight vertically extending grooves 138 that extend radially into an outer surface of the piston 120, and that extend vertically from a bottom end of the piston 120 to about two thirds of the way up the outer surface of the piston 120. The grooves 138 are equally spaced apart from one another around the outer circumference of the outer rim 142 of the piston 120, and engage with complementary ridges in other components of the lid 100, as described further below.

FIGS. 9 and 11 also show that the top circular portion 140 of the piston 120 includes an opening 144 at its center, which can be used as a fixture 144 to couple the flapper portion 122 to the piston 120. The opening 144 includes an outer ring 146, four support bars 148 that extend radially inward into the opening 144 from the outer ring 146, an inner ring 150 coupled to the four support bars 148, and a central aperture at the center of the inner ring 150. As shown in FIGS. 10 and 12, the flapper portion 122 includes a circular top flange 152, a central connecting rod 154 that extends downward from the bottom surface of the top flange 152, and a head portion 156 coupled to a bottom end of the connecting rod 154. The head portion 156 has a diameter that is wider than the central aperture at the center of the inner ring 150.

To couple the flapper portion 122 to the piston 120, the head portion 156 of the flapper portion 122 can be pushed downward through the central aperture at the center of the inner ring 150 until the head portion 156 sits below the inner ring 150 and the top flange 152 sits above the inner ring 150, such that the head portion 156 and the top flange 152 confine the flapper portion 122 within the opening 144, with the top flange 152 resting on the outer ring 146, the four support bars 148, and the inner ring 150. When a pressure below the flapper portion 122 is greater than a pressure above the flapper portion 122, such as by a predetermined threshold pressure, the top flange 152 of the flapper portion 122 can deform and allow air to flow upward through the opening 144 to equalize the pressures. When a pressure below the flapper portion 122 is less than a pressure above the flapper portion 122, however, the top flange 152 of the flapper portion 122 is restrained by the outer ring 146, the four support bars 148, and the inner ring 150 against deformations that would allow air to flow downward through the opening 144 to equalize the pressures.

In some embodiments, the cylindrical cam 118 can be fabricated in two distinct parts, one representing a lower portion of the cylindrical cam 118 below and including the groove 132, and the other representing an upper portion of the cylindrical cam 118 above the groove 132, with the upper and lower portions of the cylindrical cam divided at the groove 132 and ridge 126. In such an embodiment, the upper and lower portions of the cylindrical cam 118 can be coupled to one another with the piston 120 positioned inside their cylindrical main bodies and with the knobs 136 positioned within the groove 132. Such embodiments can make manufacturing and assembling the cylindrical cam 118 simpler and more cost-effective than in other embodiments.

Figure 13:
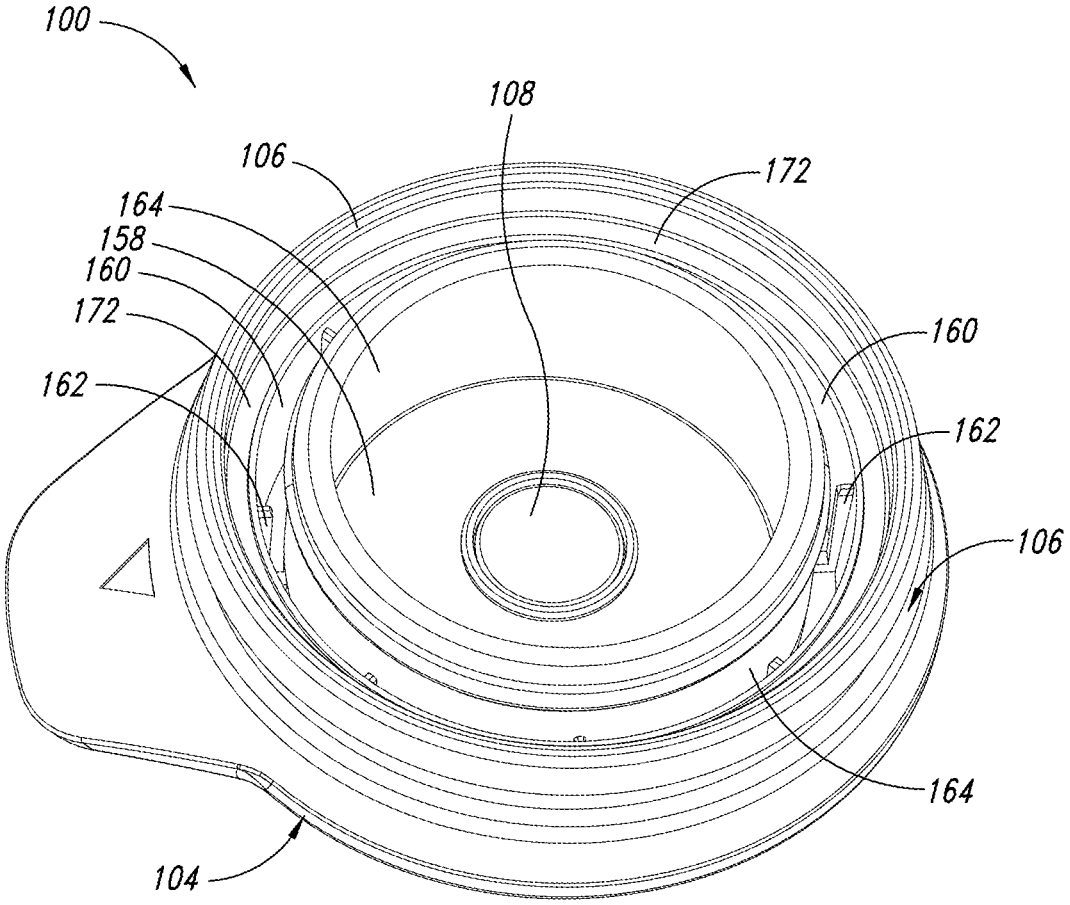
FIG. 13 illustrates the lid as shown in FIG. 8 without the piston of FIGS. 9 and 11 and without the flapper portion of FIGS. 10 and 12.

FIG. 13 illustrates the vacuum-drawing lid 100 of FIG. 1, with the top cap 102, the cylindrical cam 118, the piston 120, and the flapper portion 122 removed to reveal additional features of the lid 100. For example, FIG. 13 illustrates a top end of the flapper portion 108 illustrated in FIG. 2. As another example, FIG. 13 illustrates that the base frame 106 comprises a bowl, including a bottom circular or disk portion 158 and an outer, generally cylindrical rim 160 that extends upward from the bottom circular portion 158 to a top end 172 of the cylindrical rim 160. The top end 172 of the cylindrical rim 160 forms a ledge or a shelf on which a bottom surface of the ridge 126 of the cylindrical cam 118 can rest, and along which the ridge 126 can ride as the top cap 102 and the cylindrical cam 118 rotate. In cases where the ridge 126 includes three peaks and three valleys, bottom surfaces of the ridge 126 at the three valleys can form a relatively stable three-point support for the cylindrical cam 118. FIG. 13 also illustrates that the base frame 106 includes a plurality of vertically-extending ridges 162 that extend radially inward from an inner surface of the cylindrical rim 160, as described further below.

Figure 14:
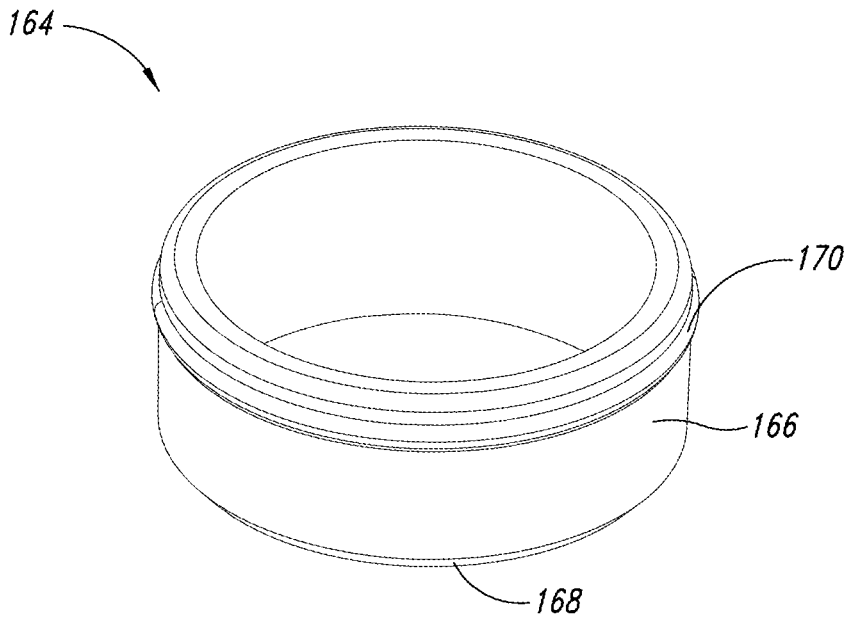
FIG. 14 illustrates a top view of a piston gasket of the lid of FIG. 1.
Figure 15:
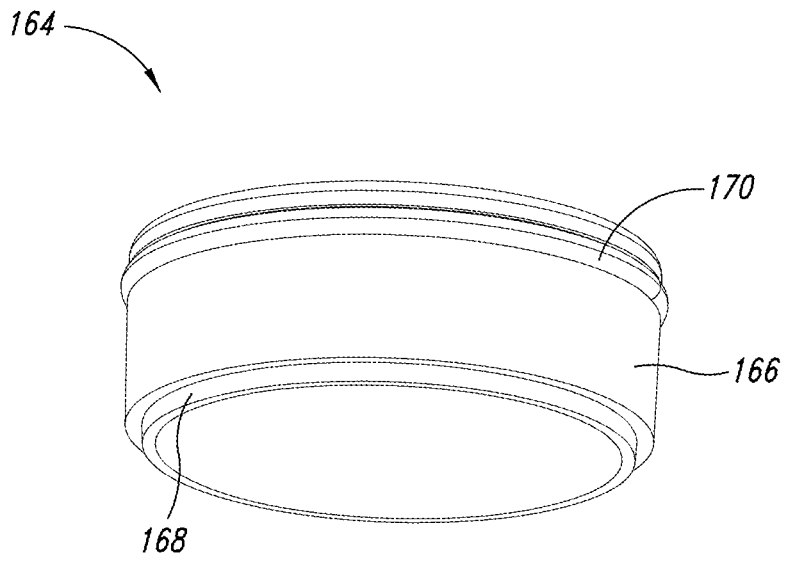
FIG. 15 illustrates a bottom view of the piston gasket of FIG. 14.

FIG. 13 also illustrates that the lid 100 includes a generally cylindrical inner gasket assembly 164 positioned on the bottom circular portion 158 and radially inward of the cylindrical rim 160 such that a gap exists between the cylindrical rim 160 and the inner gasket assembly 164, and between the ridges 162 and the inner gasket assembly 164. FIG. 14 illustrates a top perspective view, and FIG. 15 illustrates a bottom perspective view, of the inner gasket assembly 164 separated from the rest of the lid 100. As shown in FIGS. 14 and 15, the inner gasket assembly 164 includes a cylindrical main body 166 with a groove 168 formed at the bottom end of its outer surface. The inner gasket assembly 164 also includes a cylindrical portion 170 that extends around the outer surface of the gasket assembly 164 and radially outward from the rest of the inner gasket assembly 164. When the lid 100 is assembled, the cylindrical rim 142 of the piston 120 fits within the gap between the cylindrical rim 160 of the base frame 106 and the inner gasket assembly 164. Further, the inner gasket assembly 164 is dimensioned such that an outer edge of the cylindrical portion 170 of the inner gasket assembly 164 engages an inner surface of the cylindrical rim 142 of the piston 120, to form a seal between the piston 120 and the inner gasket assembly 164.

Figure 16:
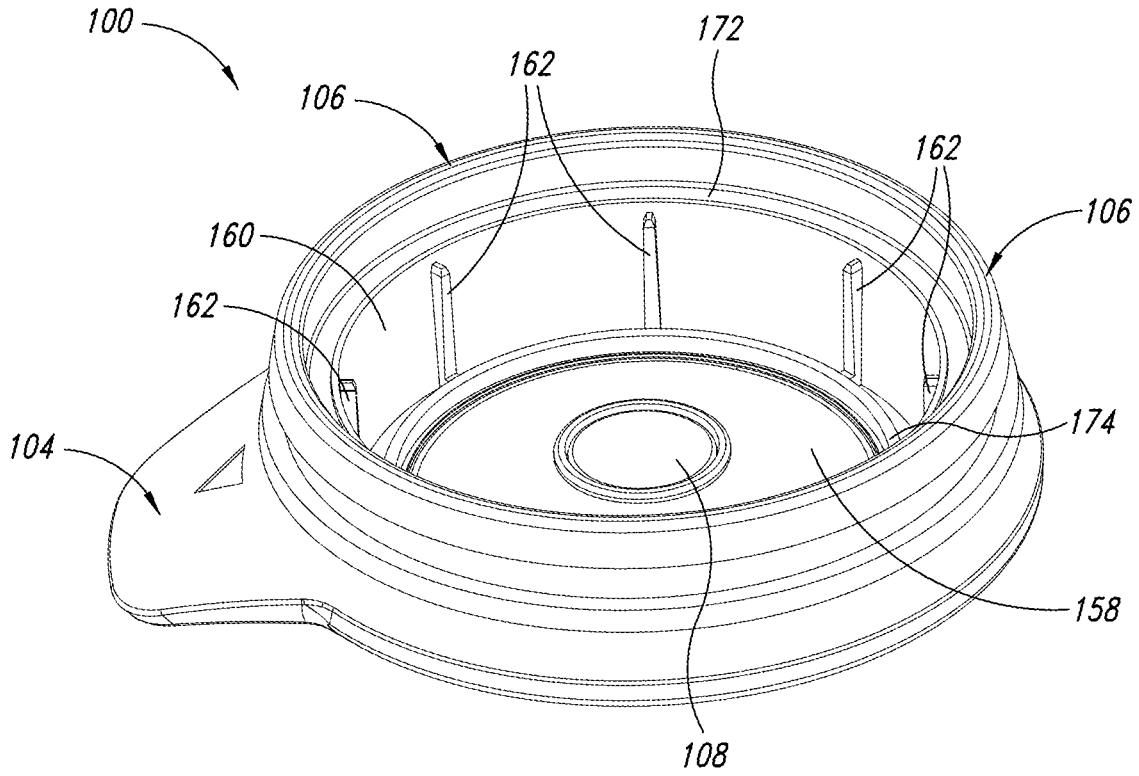
FIG. 16 illustrates the lid as shown in FIG. 13 without the piston gasket of FIGS. 14 and 15.

FIG. 16 illustrates the vacuum-drawing lid 100 of FIG. 1, with the top cap 102, the cylindrical cam 118, the piston 120, the flapper portion 122, and the inner gasket assembly 164 removed to reveal additional features of the lid 100. For example, FIG. 16 illustrates that the base frame 106 includes eight ridges 162 that extend radially inwardly from the outer rim 160 and vertically upward from the bottom circular portion 158 to near a top end portion of the outer rim 160. The eight ridges 162 (five are visible in FIG. 16) are complementary to the grooves 138 formed in the outer surface of the piston 120, and are equally spaced apart from one another around the inner circumference of the outer rim 160. Thus, when the piston 120 is coupled to the rest of the lid 100, the ridges 162 are seated within and engaged with the grooves 138, so that the piston 120 is rotationally locked to the base frame 106 but translatable upwards and downwards with respect to the base frame 106.

When the lid 100 is assembled, the knobs 136 of the piston 120 are seated within the groove 132 in the inner surface 130 of the cylindrical cam 118 such that the cylindrical cam 118 is rotatable with respect to the piston 120 and such that the piston 120 is translatable with respect to the cylindrical cam 118. In particular, because the cylindrical cam 118 is rotatable but not translatable with respect to the base frame 106, the piston 120 is translatable but not rotatable with respect to the base frame 106, and the knobs 136 are seated within the sinusoidal groove 132, rotation of the cylindrical cam 118 with respect to the base frame 106 causes the linear translation of the piston 120 up and down. Further, because the sinusoidal shape of the groove 132 has two peaks and two valleys as it extends around the circumference of the inner surface 130 of the cylindrical cam 118, the groove 132 is symmetrical, the two knobs 136 fit within the two peaks at the same time and within the two valleys at the same time, and one 360-degree rotation of the cylindrical cam 118 causes two up-and-down reciprocations of the piston 120. In cases where the sinusoidal shape of the groove 132 has three peaks and three valleys as it extends around the circumference of the inner surface 130 of the cylindrical cam 118 and the piston 120 includes three knobs 136 instead of two, the three knobs 136 fit within the three peaks at the same time and within the three valleys at the same time, and one 360-degree rotation of the cylindrical cam 118 causes three up-and-down reciprocations of the piston 120.

FIG. 16 also illustrates that the base frame 106 includes a circular ridge 174 that extends upwards from its bottom circular portion 158 and that is positioned radially inward from the outer rim 160 and from the ridges 162 such that a gap exists between the circular ridge 174 and the outer rim 160 and between the circular ridge 174 and the ridges 162. When the lid 100 is in use, the inner gasket assembly 164 is positioned such that the circular ridge 174 is positioned within the groove 168 at the bottom of the inner gasket assembly 164, such that the inner gasket assembly 164 is stationary with respect to the base frame 106, and to form a seal between the base frame 106 and the gasket assembly 164 at the location where the ridge 174 engages the groove 168.

Figure 17:
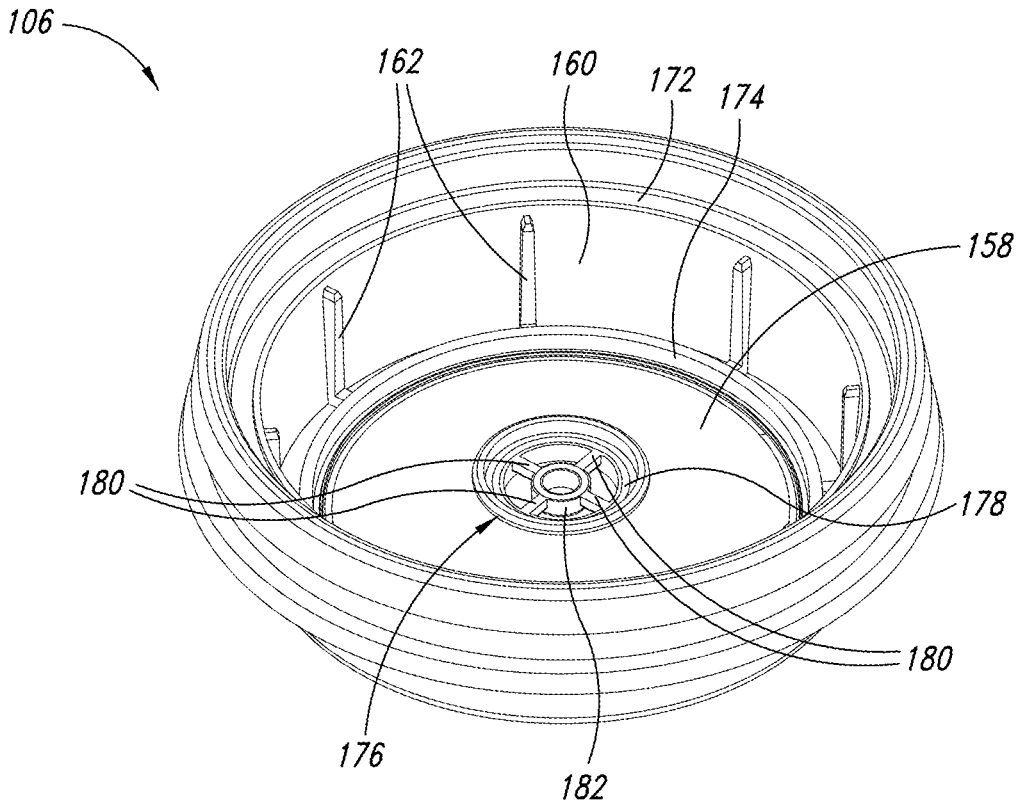
FIG. 17 illustrates a top view of a base frame of the lid of FIG. 1.
Figure 18:
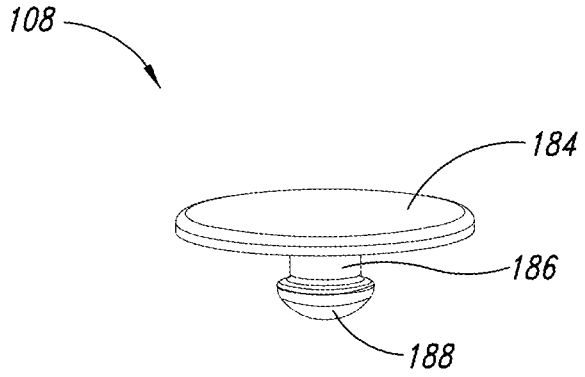
FIG. 18 illustrates a top view of a flapper portion of a flapper valve formed with the base frame of FIG. 17.
Figure 19:
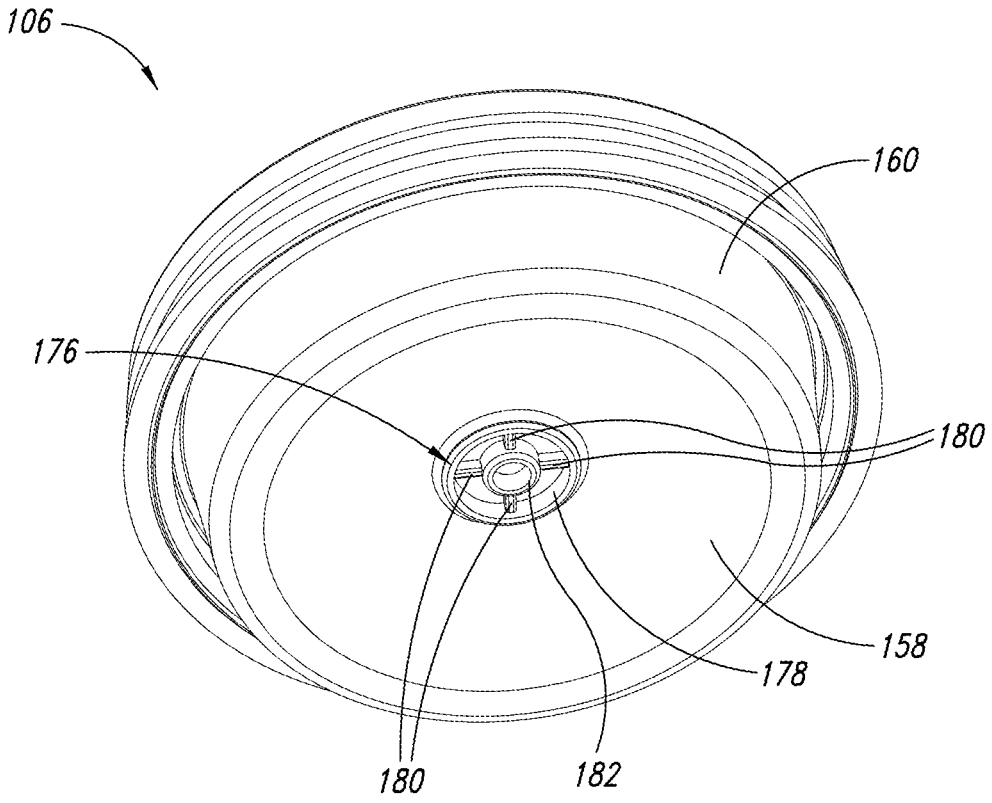
FIG. 19 illustrates a bottom view of the base frame of FIG. 17.
Figure 20:
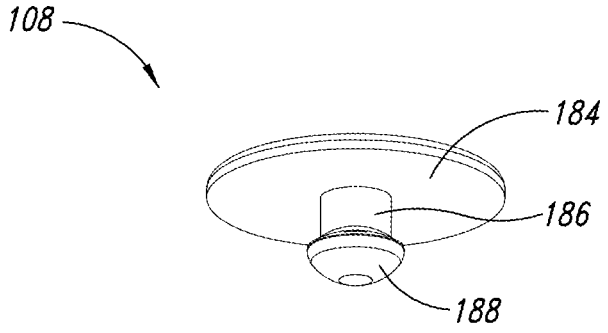
FIG. 20 illustrates a bottom view of the flapper portion of FIG. 18.

FIG. 17 illustrates a top perspective view of the base frame 106 separated from the rest of the lid 100, including the flapper portion 108, and FIG. 18 illustrates a top perspective view of the flapper portion 108. FIG. 19 illustrates a bottom perspective view of the base frame 106 separated from the rest of the lid 100, including the flapper portion 108, and FIG. 20 illustrates a bottom perspective view of the flapper portion 108. FIGS. 17 and 19 show that the bottom circular portion 158 of the base frame 106 includes an opening 176 at its center, which can be used as a fixture 176 to couple the flapper portion 108 to the base frame 106. The opening 176 includes an outer ring 178, four support bars 180 that extend radially inward into the opening 176 from the outer ring 178, an inner ring 182 coupled to the four support bars 180, and a central aperture at the center of the inner ring 182. As shown in FIGS. 18 and 20, the flapper portion 108 includes a circular top flange 184, a central connecting rod 186 that extends downward from the bottom surface of the top flange 184, and a head portion 188 coupled to a bottom end of the connecting rod 186. The head portion 188 has a diameter that is wider than the central aperture at the center of the inner ring 182.

To couple the flapper portion 108 to the base frame 106, the head portion 188 of the flapper portion 108 can be pushed downward through the central aperture at the center of the inner ring 182 until the head portion 188 sits below the inner ring 182 and the top flange 184 sits above the inner ring 182, such that the head portion 188 and the top flange 184 confine the flapper portion 108 within the opening 176, with the top flange 184 resting on the outer ring 178, the four support bars 180, and the inner ring 182. When a pressure below the flapper portion 108 is greater than a pressure above the flapper portion 108, such as by a predetermined threshold pressure, the top flange 184 of the flapper portion 108 can deform and allow air to flow upward through the opening 176 to equalize the pressures. When a pressure below the flapper portion 108 is less than a pressure above the flapper portion 108, however, the top flange 184 of the flapper portion 108 is restrained by the outer ring 178, the four support bars 180, and the inner ring 182 against deformations that would allow air to flow downward through the opening 176 to equalize the pressures.

Figure 21:
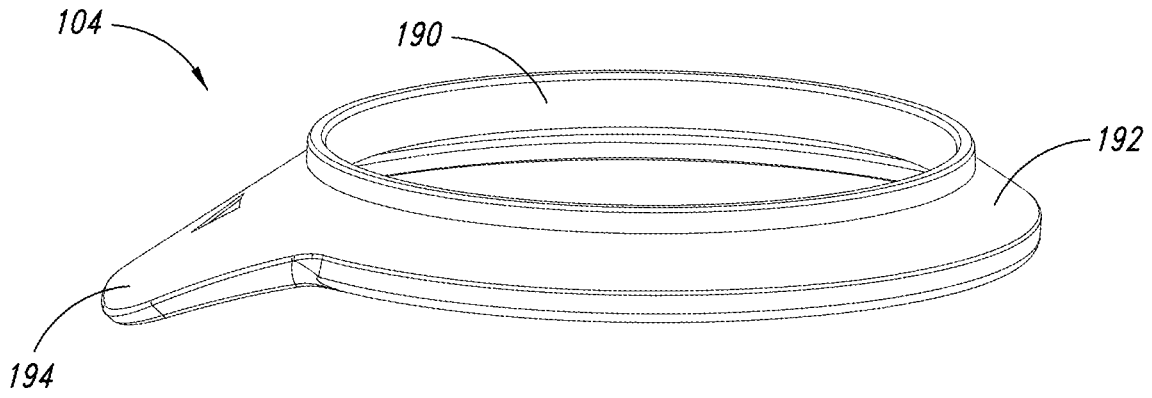
FIG. 21 illustrates a top view of a container gasket of the lid of FIG. 1.
Figure 22:
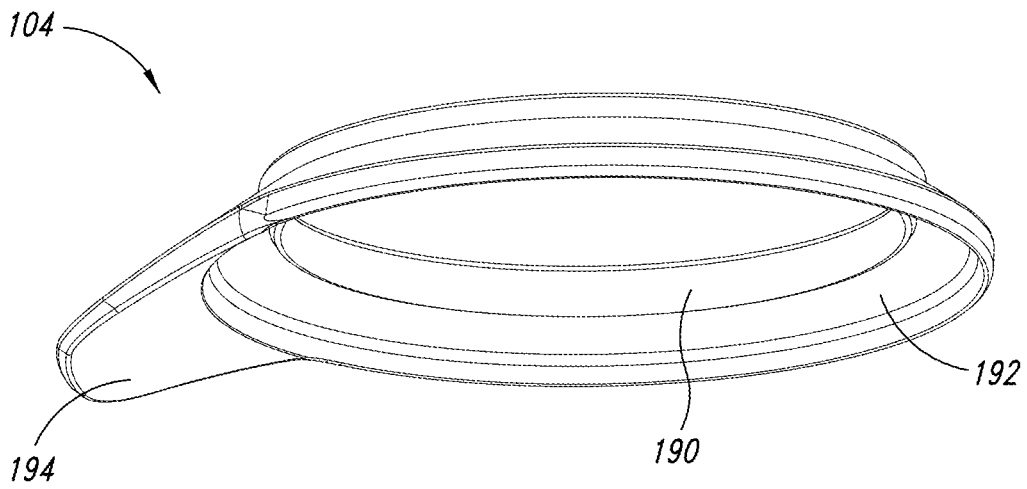
FIG. 22 illustrates a bottom view of the container gasket of FIG. 21.

FIG. 21 illustrates a top perspective view, and FIG. 22 illustrates a bottom perspective view, of the container gasket 104. As shown in FIGS. 21 and 22, the container gasket 104 includes a vertical cylindrical wall 190 having an inner surface that has dimensions complementary to dimensions of an outer surface of the cylindrical rim 160 of the base frame 106, so that the inner surface of the wall 190 of the container gasket 104 can fit snugly over the outer surface of the cylindrical rim 160 of the base frame 106 to form a seal therewith. The container gasket 104 also includes a conical flange 192 that extends radially outward and downward away from the vertical cylindrical wall 190. The conical flange 192 has dimensions complementary to dimensions of a rim of the container with which the lid 100 is to be used, so that the conical flange 192 of the container gasket 104 can fit snugly over an upper surface of the rim of the container to form a seal therewith.

The container gasket 104 also includes a tab 194 that is coupled to and extends radially away from the conical flange 192. When the lid 100 is in use and the conical flange 192 is sealed with a rim of a container, a user can pull on the tab 194 to break the seal between the conical flange 192 and the rim of the container, and/or to break the seal between the vertical cylindrical wall 190 and the outer surface of the cylindrical rim 160 of the base frame 106, to release the lid 100 from the container. In some embodiments, the vertical cylindrical wall 190 can include a small opening that extends therethrough at a location above the tab 194, to further assist in breaking a seal between the lid 100 and the container.

Figure 23:
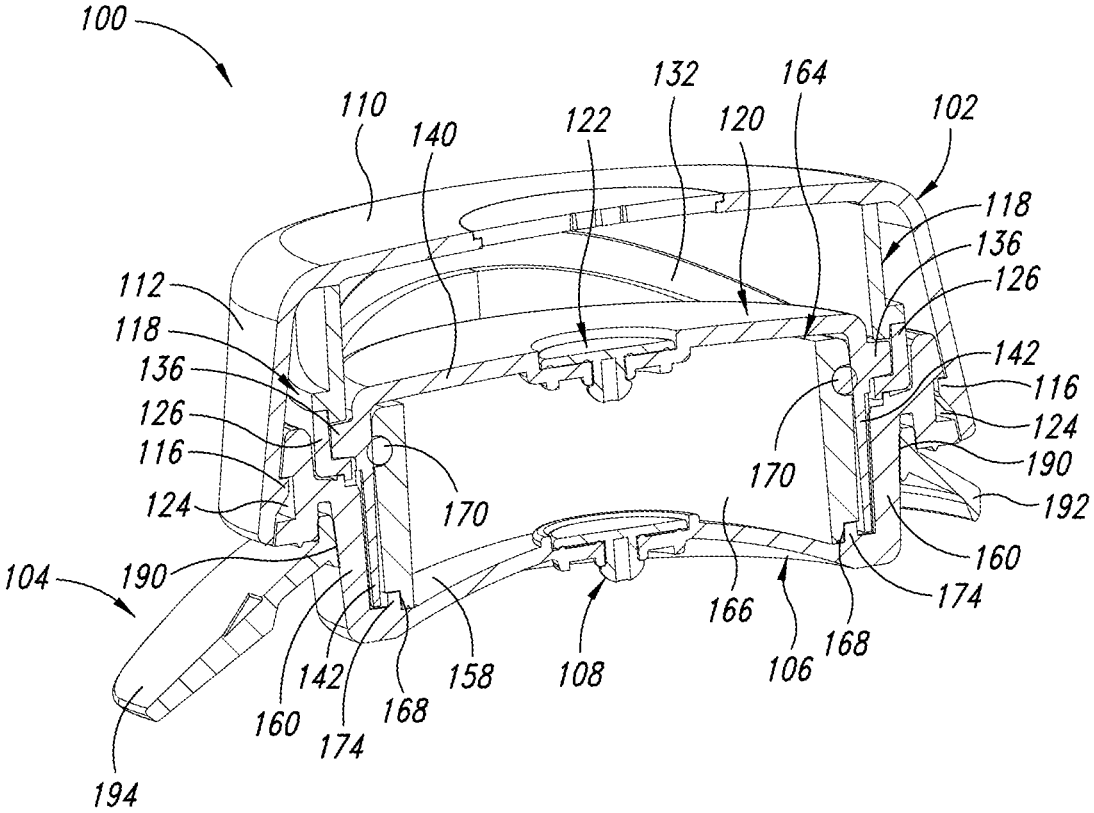
FIG. 23 illustrates a cross-sectional side view of the lid of FIG. 1.

FIG. 23 illustrates a cross-sectional side view of the lid 100, and various chambers and gas flow paths that exist inside the lid 100. To use the lid 100, a user can place the bottom gasket 104 on an upper rim of a container such as a glass mason jar. The user can then push the lid 100 onto the rim of the container to create a seal between the container and the container gasket 104. Such actions create a first chamber inside the container and below the lid 100. The first chamber is separated by the first, bottom flapper valve and its flapper portion 108 from a second chamber bounded at its bottom by the circular portion 158 of the base frame 106, at its sides by the cylindrical main body 166 of the inner gasket assembly 164, and at its top by the circular portion 140 of the piston 120. The second chamber is separated by the second, top flapper valve and its flapper portion 122 from a third chamber bounded at its bottom by the circular portion 140 of the piston 120, at its sides by the inner surface 130 of the cylindrical cam 118, and at its top by the circular portion 110 of the top cap 102. The third chamber is not sealed from the atmosphere and can therefore be considered to be at a constant pressure equivalent to atmospheric pressure.

The user can then rotate the top cap 102 a quarter turn with respect to the base frame 106 and the container gasket 104, which causes the cylindrical cam 118 to rotate a quarter turn with respect to the base frame 106 and the container gasket 104. As the cylindrical cam 118 rotates and the piston 120 is prevented from rotating by the ridges 162, the elevations of the groove 132 at the locations where the knobs 136 are seated within the groove 132 move upwards, causing the knobs 136 and the rest of the piston 120 to move upwards through the lid 100. Moving the piston 120 upwards in this manner causes the volume of the second chamber to increase and the pressure inside the second chamber and above the flapper portion 108 to decrease to a level below the pressure in the first chamber inside the container and below the flapper portion 108. Decreasing the pressure above the flapper portion 108 in this manner actuates the flapper portion 108 so that some air passes from the first chamber, upwards through the opening 176, into the second chamber.

The user can then rotate the top cap 102 another quarter turn with respect to the base frame 106, which causes the piston 120 to move downwards through the lid 100. Moving the piston 120 downwards in this manner causes the volume of the second chamber to decrease and the pressure inside the second chamber and below the flapper portion 122 to increase to a level above the pressure in the third chamber and above the flapper portion 122. Increasing the pressure below the flapper portion 122 in this manner actuates the flapper portion 122 so that some air passes from the second chamber, upwards through the opening 144, into the third chamber and out of the lid 100.

By repeatedly turning the top cap 102 in this manner, air can be repeatedly drawn out of the container and expelled out of the lid 100, thereby drawing a vacuum in the container and under the lid 100. In some embodiments, a vacuum of about 10 inHg below atmospheric pressure can be drawn with the lid 100 by turning the top cap 102 between six and eight full 360-degree turns. Once a vacuum is drawn in this manner, the user can leave the container and the lid 100 to sit for any desired period of time. For example, in tests, it has been found that the lid 100 described herein can be used to hold a vacuum for at least three days, and it is expected that the features described herein can be used to hold a vacuum for much longer and perhaps indefinitely. When the user desires to re-open the container by breaking the seal, releasing the vacuum, and removing the lid 100, the user can pull the tab 194 of the container gasket 104 to break the seal of the first chamber, either by separating the container gasket 104 from the upper rim of the container, or by separating the container gasket 104 from the base frame 106.

The various components of the lid 100 described herein can be manufactured from any suitable materials, with polyoxymethylene, acrylonitrile butadiene styrene, and silicone being a few examples. The lid 100 can be used in a wide variety of situations or applications, such as to seal food products such as tobacco, coffee beans, or wine to preserve their freshness, to seal food items such as vegetables with vinegar or brine to accelerate a pickling process, to remove air or other gases entrained in a liquid, to assist in making kim chi, or sauerkraut, etc.

The lid 100 has various advantages over other sealing and vacuum-drawing systems. For example, the lid 100 is advantageous because all of the components needed to draw a vacuum and seal a container are self-contained in, or are integral with, the lid 100. As other examples, the lid 100 has a relatively low profile and is stackable, which makes storing a set of the lids 100 more efficient. Further, the lid 100 can be used to seal a wide variety of different containers having a variety of dimensions, because the container gasket 104 can be pressed against and sealed to a wide variety of upper rims without regard to their precise dimensions and without regard to the type of threads they may have.

U.S. provisional patent application No. 62/456,303, filed Feb. 8, 2017, to which this application claims priority, is hereby incorporated herein by reference in its entirety.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A lid for sealing a container, comprising:

a base frame including a first valve and a plurality of vertically extending ridges;

a piston including a second valve and a plurality of vertically extending grooves configured to engage with the ridges; and a chamber bounded at least in part by the base frame and the piston, the piston movable in a first direction with respect to the base frame to change a volume of the chamber to actuate the first valve, the piston movable in a second direction opposite to the first direction to change the volume of the chamber to actuate the second valve.

2. The lid of claim 1, wherein the engagement of the grooves with the ridges prevents the piston from rotating with respect to the base frame but allows the piston to translate with respect to the base frame.

3. The lid of claim 1, further comprising: an inner gasket assembly engaged with and sealed against the base frame and engaged with and sealed against the piston.

4. The lid of claim 1, further comprising: a bottom gasket that extends around and is sealed against an outer surface of the base frame.

5. A lid for sealing a container, comprising:

a base frame including a first valve;

a piston including a second valve, a main body and a knob protruding radially outward from the main body;

a chamber bounded at least in part by the base frame and the piston;

a cylindrical cam including a hollow body with an inner surface and a groove formed in the inner surface, the knob being positioned in the groove so that rotation of the cylindrical cam causes the piston to move with respect to the base frame to change the volume of the chamber;

the piston movable in a first direction with respect to the base frame to change a volume of the chamber to actuate the first valve, the piston movable in a second direction opposite to the first direction to change the volume of the chamber to actuate the second valve.

6. The lid of claim 5, wherein the groove is a sinusoidal groove.

7. The lid of claim 5, further comprising a top cap including a plurality of vertically-extending ridges, the hollow body of the cylindrical cam having an outer surface and including a plurality of vertically-extending grooves in the outer surface, the vertically extending grooves engaged with the vertically-extending ridges.

8. The lid of claim 7, wherein the engagement of the grooves with the ridges prevents the top cap from rotating with respect to the cylindrical cam.

9. The lid of claim 5, further comprising a top cap including a plurality of protrusions, the base frame having an outer surface and including a circumferential groove formed in the outer surface, the circumferential groove being engaged with the protrusions.

10. The lid of claim 9, wherein the engagement of the groove with the protrusions prevents the top cap from translating with respect to the base frame.

11. The lid of claim 5, further comprising an inner gasket assembly engaged with and sealed against the base frame and engaged with and sealed against the piston.

12. The lid of claim 5, further comprising a bottom gasket that extends around and is sealed against an outer surface of the base frame.

13. A lid for sealing a container, comprising:

a base frame having a first valve, an outer surface, and a bottom gasket extending around and sealed against the outer surface;

a piston including a second valve; and a chamber bounded at least in part by the base frame and the piston;

the piston movable in a first direction with respect to the base frame to change a volume of the chamber to actuate the first valve, the piston movable in a second direction opposite to the first direction to change the volume of the chamber to actuate the second valve.

14. The lid of claim 13, wherein the bottom gasket is configured to engage with and create a seal against an upper rim of the container.

15. The lid of claim 13, further comprising a bottom gasket that extends around and is sealed against an outer surface of the base frame.

* * * * *